US010920964B2

(12) United States Patent
Vidakovic

(10) Patent No.: US 10,920,964 B2
(45) Date of Patent: Feb. 16, 2021

(54) ADJUSTABLE LUMINAIRE

(71) Applicant: SIGNIFY HOLDING B.V., Eindhoven (NL)

(72) Inventor: Voya Alex Vidakovic, Marietta, GA (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/697,015

(22) Filed: Nov. 26, 2019

(65) Prior Publication Data

US 2020/0166198 A1 May 28, 2020

Related U.S. Application Data

(60) Provisional application No. 62/772,007, filed on Nov. 27, 2018.

(51) Int. Cl.

| | |
|---|---|
| ***F21V 14/02*** | (2006.01) |
| ***F21V 17/12*** | (2006.01) |
| ***F21V 21/04*** | (2006.01) |
| ***F21S 8/02*** | (2006.01) |

(52) U.S. Cl.
CPC ..... *F21V 14/02* (2013.01); *F21S 8/026* (2013.01); *F21V 17/12* (2013.01); *F21V 21/042* (2013.01)

(58) Field of Classification Search
CPC ..... F21V 21/14; F21V 21/30; F21V 14/02; F21V 19/02; F21S 8/02; F21S 8/026
See application file for complete search history.

(56) References Cited

U.S. PATENT DOCUMENTS

| | | | | |
|---|---|---|---|---|
| 4,729,080 | A * | 3/1988 | Fremont | F21V 21/04 362/148 |
| 5,452,193 | A * | 9/1995 | Hinnefeld | F21S 8/02 362/148 |
| 6,779,908 | B1 * | 8/2004 | Ng | F21S 8/02 362/147 |
| 7,575,345 | B2 * | 8/2009 | Gauthier | F21S 8/02 362/287 |
| 9,845,928 | B1 | 12/2017 | Tyson et al. | |
| 2017/0184285 | A1 * | 6/2017 | Visser | F21V 21/047 |
| 2017/0227201 | A1 * | 8/2017 | Fujisawa | F21V 23/0435 |
| 2019/0234593 | A1 | 8/2019 | Stevens et al. | |
| 2020/0116340 | A1 * | 4/2020 | Nikooyan | F21S 8/026 |

* cited by examiner

*Primary Examiner* — Alexander K Garlen

(57) ABSTRACT

An adjustable luminaire can include an upper body rotatably attached to an intermediate body. The upper body can contain a light module have an upper wall of varying height. The intermediate body can have an intermediate wall of varying height and the upper body and intermediate body can be rotatably attached so that rotating the upper body adjusts the angle at which light from the light module is emitted from the adjustable luminaire.

20 Claims, 13 Drawing Sheets

ADJUSTABLE LUMINAIRE

RELATED APPLICATIONS

The present application claims priority to U.S. Provisional Patent Application No. 62/772,007 titled "Adjustable Luminaire" and filed on Nov. 27, 2018, the entire contents of which are incorporated herein by reference.

TECHNICAL FIELD

Embodiments of the technology relate generally to luminaires and more particularly to luminaires that are adjustable.

BACKGROUND

Luminaires often must have the capability to be adjusted so that light is emitted from the luminaire at a desired angle. Prior attempts to make luminaires adjustable often have shortcomings in that they are difficult to adjust and/or are overly complex. Another shortcoming of prior adjustable luminaires is that they are limited to a particular range of motion that may be inadequate. These challenges are a particular problem for luminaires that are recessed, such as in a ceiling. Recessed luminaires are further complicated in that they often are inserted into a recessed housing attached to the ceiling wherein the recessed housing makes adjustability more challenging. A further complication for adjustable luminaires is that in certain cases the adjustable luminaire must meet one or more air tight standards that govern the amount of air that may pass through the adjustable luminaire. Accordingly, a simpler luminaire that permits adjustment of the luminaire so that light is emitted through a range of angles would be beneficial. Additionally, an adjustable luminaire that meets one or more air tight standards would also be beneficial.

SUMMARY

The present disclosure is generally directed to an adjustable luminaire that permits adjustment of the angle from which light is emitted from the luminaire. In one example embodiment, the present disclosure is directed to a luminaire comprising a cylindrical upper body, a cylindrical intermediate body, and a base. The cylindrical upper body has an upper wall of varying height and the upper wall forms an upper angled opening. A light module is disposed within the cylindrical upper body and emits light along a light emitting axis. The cylindrical intermediate body has an intermediate wall of varying height forming an intermediate angled opening and an intermediate lower opening. The cylindrical upper body is attached to the cylindrical intermediate body where the upper angled opening and the intermediate angled opening meet. The cylindrical intermediate body is also rotatably attached to the base at the intermediate lower opening. The base comprises a light emitting opening for emitting light from the light module.

In another example embodiment, the present disclosure is directed to a luminaire comprising a cylindrical upper body and a cylindrical intermediate body. The cylindrical upper body comprises an upper wall of varying height, the upper wall forming an upper angled opening. A light module is disposed in the cylindrical upper body and is configured to emit light along a light emitting axis. The cylindrical intermediate body comprises an intermediate wall of varying height, the intermediate wall forming an intermediate angled opening and an intermediate lower opening. The cylindrical intermediate body is attached to the cylindrical upper body where the upper angled opening and the intermediate angled opening meet. Light from the light module is emitted through the intermediate lower opening.

The foregoing embodiments are non-limiting examples and other aspects and embodiments will be described herein.

BRIEF DESCRIPTION OF THE DRAWINGS

The drawings illustrate only example embodiments and are therefore not to be considered limiting of the scope of this disclosure. The elements and features shown in the drawings are not necessarily to scale, emphasis instead being placed upon clearly illustrating the principles of the example embodiments. Additionally, certain dimensions or positions may be exaggerated to help visually convey such principles.

DETAILED DESCRIPTION OF EXAMPLE EMBODIMENTS

The example embodiments discussed herein are directed to adjustable luminaires. While the example embodiments described herein relate to recessed luminaires, the example embodiments can be applied to a variety of indoor and outdoor lighting systems, including in homes, offices, schools, garages, stadiums, warehouses, and a variety of other buildings and environments.

The adjustable luminaires described herein can provide a number of benefits. Examples of such benefits can include, but are not limited to, simpler installation and adjustment, a greater range of adjustment, the elimination of unnecessary complexity for adjustable luminaires, and the capability to meet one or more air tight standards.

Figure 1:
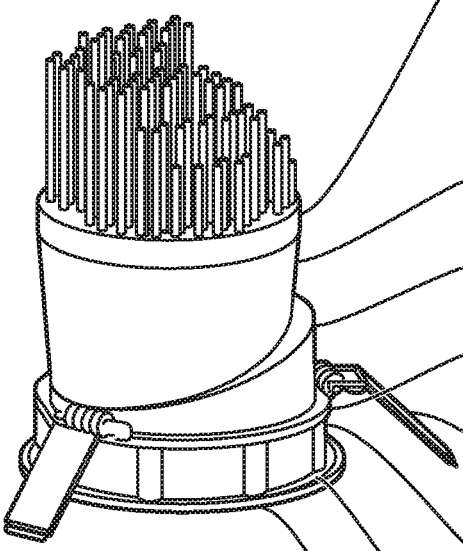
FIG. 1 is a top perspective view of a rotatable luminaire in accordance with an example embodiment.
Figure 2:
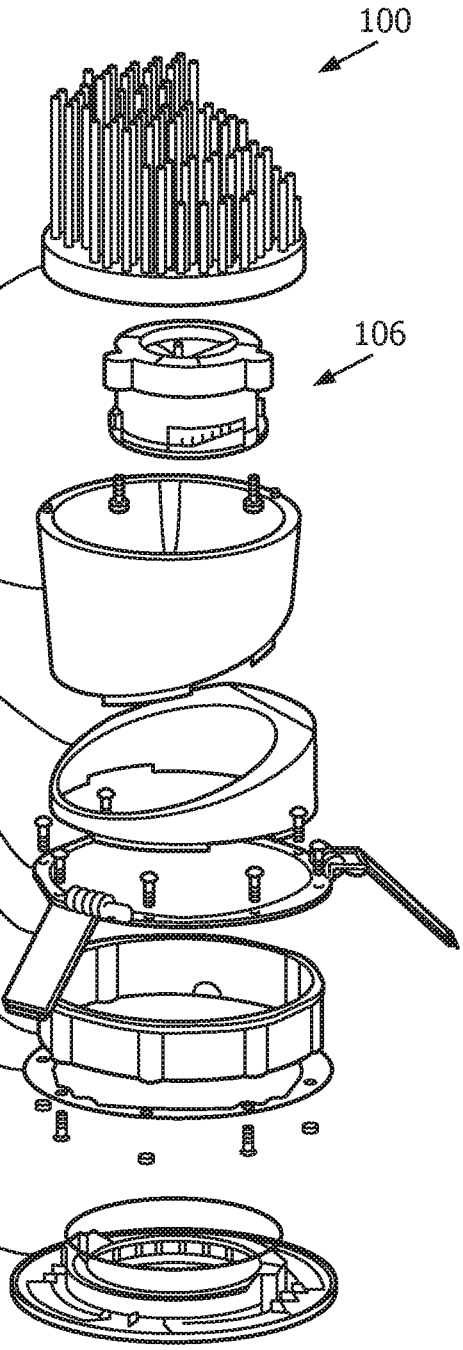
FIG. 2 is an exploded view of the rotatable luminaire shown in FIG. 1 in accordance with an example embodiment.

Referring to FIGS. 1 and 2, a top perspective view and an exploded view, respectively, of an example adjustable luminaire 100 are shown. Portions of the adjustable luminaire 100 are rotatable so that light can be directed straight down from the luminaire 100 or light can be emitted at an angle. The adjustable luminaire 100 comprises a top 103 which includes a heat sink extending from the top. Continuing downward from the top 103, the example luminaire 100 also comprises a cylindrical upper body 105, a cylindrical intermediate body 107, and a base 115. A slip plate 113 is attached to the top of the base 115 and a base flange 117 is attached to the bottom of the base 115. Below the base 115 and the base flange 117, an optional example trim assembly 120 is attached. The adjustable luminaire 100 is configured for a recessed installation in a ceiling so that the base flange 117 rests against a ceiling when the luminaire 100 is inserted into the ceiling and retention brackets 110 (e.g., mouse trap springs) attached to the slip plate secure the luminaire by pressing against a top side of the ceiling. A light module 106 is disposed within the cylindrical upper body 105 of the luminaire. The light module can comprise an optic, an optic holder, and a light source, such as an LED. The light source emits light in a downward direction through the cylindrical upper body 105, through the cylindrical intermediate body 107, through the base 115, and exiting through a light emitting opening in the base 115.

The example luminaire 100 can be adjusted to emit light at different angles by rotating the cylindrical upper body 105. In the example embodiment shown in FIGS. 1 and 2, the cylindrical intermediate body 107 is also rotatable to adjust the direction of the emitted light. While the cylindrical upper body 105 and the cylindrical intermediate body 107 are rotatable, the base 115 remains stationary and is secured to the ceiling by the retention brackets 110. It should be understood that in alternate embodiments, a luminaire could be configured so that the cylindrical intermediate body 107 is not rotatable or that the cylindrical intermediate body 107 and the base 115 are a single component that is not rotatable.

Figures 3, 4:
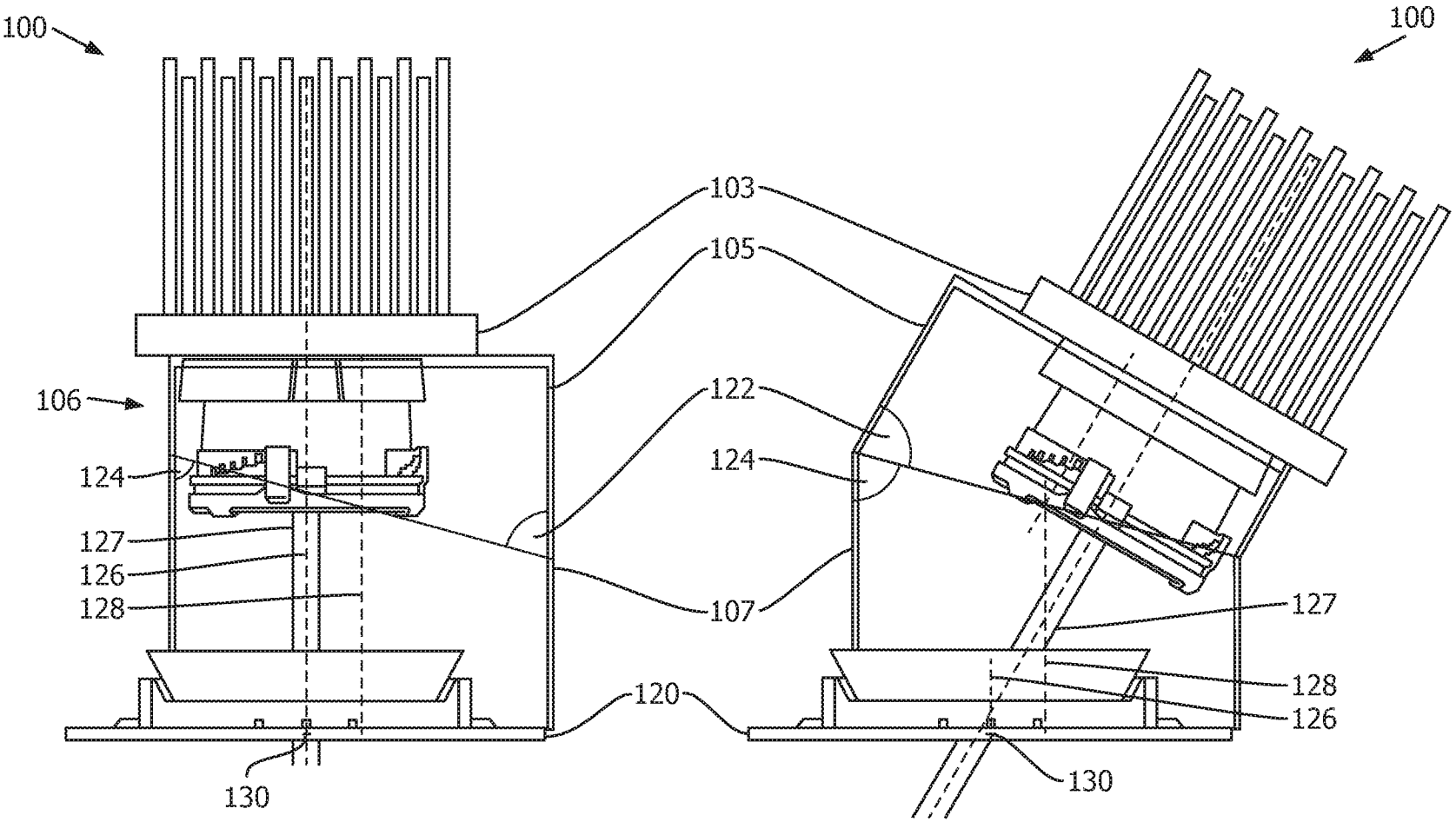
FIG. 3 is a side view of the rotatable luminaire of FIG. 1 with a side hidden from view and showing the internal features in accordance with an example embodiment.
FIG. 4 is a side view of the rotatable luminaire of FIG. 1 with a side hidden from view and showing the internal features in accordance with an example embodiment.

FIGS. 3 and 4 illustrate the adjustment of the emitted light from the luminaire 100 in greater detail. In FIG. 3, the emitted light is pointed straight downward below the luminaire, whereas in FIG. 4 the cylindrical upper body 105 has been rotated so that light is emitted off to one side. As shown in FIG. 3, the optional example trim assembly 120 and the top 103 are centered on a pivot point axis 126 running vertically through the center of the top 103 and the center of the trim assembly 120 and passing through a pivot point 130 located at the light emitting opening. In contrast, the cylindrical upper body 105 and cylindrical intermediate body 107 are centered about an offset axis 128 that is parallel to but offset from the pivot point axis by a distance d. The cylindrical upper body 105 and cylindrical intermediate body 107 also are each defined by a cylindrical wall of varying height. For the cylindrical upper body 105, the varying height of the cylindrical upper wall defines an upper angled opening at the bottom of the cylindrical upper body 105, the upper angled opening defining an upper plane forming an upper acute angle 122 between the cylindrical upper wall and the upper plane where the height of the cylindrical upper wall is greatest. Similarly, the cylindrical intermediate body 107 has a cylindrical intermediate wall defining an intermediate angled opening at the top of the cylindrical intermediate body 107, the intermediate angled opening defining an intermediate plane forming an intermediate acute angle 124 between the cylindrical intermediate wall and the intermediate plane where the height of the cylindrical intermediate wall is greatest.

In the example shown in FIGS. 1-4, the acute angles 122 and 124 are 17.5 degrees, but in alternate embodiments the angles may have other measurements. When the acute angles 122 and 124 are located on opposite sides of the luminaire 100 as shown in FIG. 3, the light module 106 is oriented to emit light along light emitting axis 127 which is coincident with pivot point axis 126. However, as the cylindrical upper body 105 is rotated relative to the cylindrical intermediate body 107, the light is emitted from the luminaire 100 at an angle. As shown in FIG. 4, when the cylindrical upper body 105 is rotated 180 degrees so that the acute angles 122 and 124 are adjacent, the acute angles 122 and 124 are additive so that the light module 106 emits light along light emitting axis 127 at an angle of 35 degrees from the pivot point axis 126.

Notably, as shown in FIGS. 3 and 4, the light emitting axis 127 passes through pivot point 130 in both the orientation shown in FIG. 3 and the orientation shown in FIG. 4. The offset distance d between the pivot point axis 126 and the offset axis 128 is selected so that the light emitting axis 127 passes through the pivot point 130 in any rotational orientation of the cylindrical upper body 105. The single pivot point 130 for the light emitting axis 127 in any rotational orientation is significant because it is desirable to have the emitted light exit the luminaire at the same point regardless of the angle at which the light is emitted. The offset distance d is determined by the magnitude of the acute angles 122 and 124. In alternate embodiments where one or more the acute angles 122 and 124 have a different measurement, the offset distance d would be adjusted so that the light emitting axis always passes through the pivot point.

Figure 6:
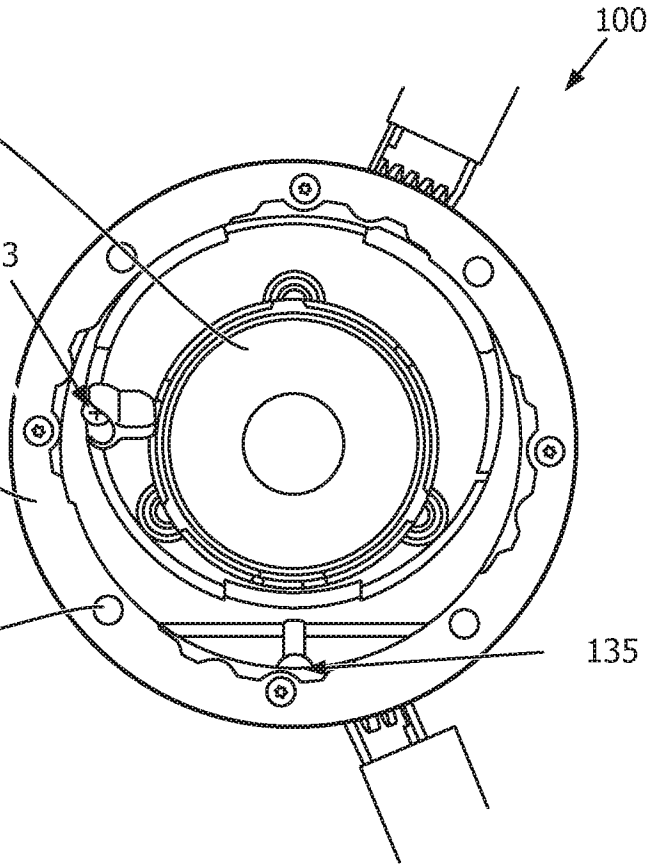
FIG. 6 is another bottom view of the rotatable luminaire of FIG. 1 in accordance with an example embodiment.
Figure 5:
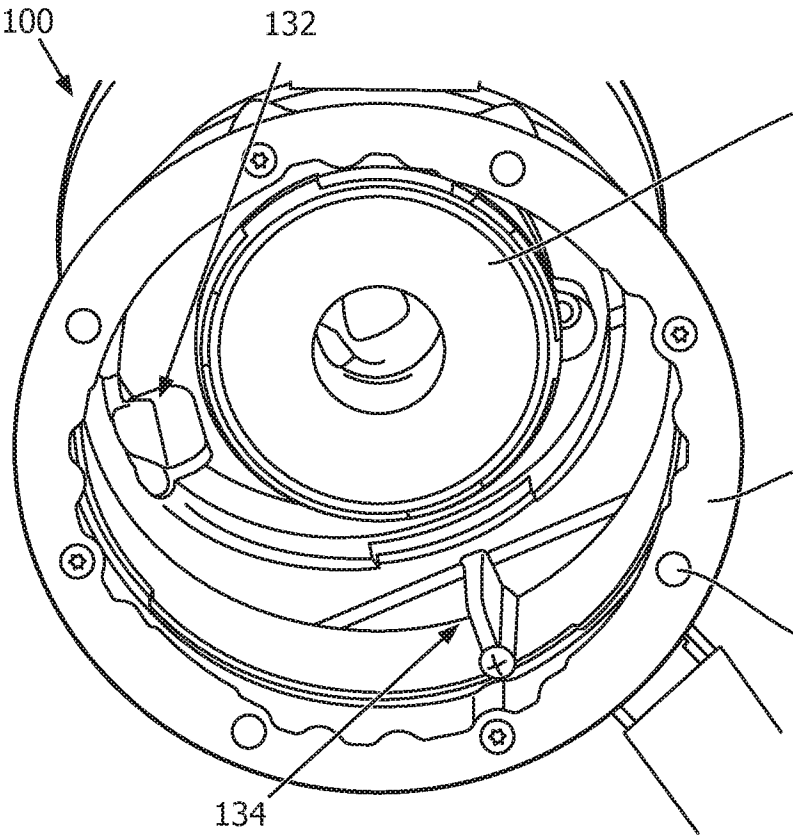
FIG. 5 is a bottom view of the rotatable luminaire of FIG. 1 in accordance with an example embodiment.

Referring to FIGS. 5 and 6, bottom views of the example luminaire 100 are shown. The bottom views show the light module 106 located within the cylindrical upper body 105 of the luminaire. The bottom views also illustrate an upper tab 132 attached to the inner surface of the cylindrical upper body 105 and an intermediate tab 134 attached to the inner surface of the cylindrical intermediate body 107. The upper tab 132 and intermediate tab 134 can be used to adjust the rotation of the cylindrical upper body 105 and the cylindrical intermediate body 107, respectively, to a desired position and the fastener 133, 135 located within each tab can be used to lock the respective component into place. When the fasteners 133, 135 in each of the upper tab 132 and the intermediate tab 134 are tightened, the tightening action clamps the components of the luminaire 100 together assisting in creating an air tight seal for the luminaire 100. Markings with degree measurements located on the inside surface of the luminaire 100, as seen in FIG. 5, can also assist the user in adjusting the positions of the components. FIGS. 5 and 6 also show that optional magnets 138 can be included in the base 115 for attaching trim assembly 120.

In some example applications, it can be desirable for a recessed luminaire to satisfy one or more air tight standards specifying the amount of air that is able to pass through the luminaire, for example, for energy efficiency purposes related to heating and cooling. The example embodiments shown in FIGS. 1-6 achieve an air tight rating using a recess and complementary snap fit rim for attaching the rotating components. For example, as can be seen in FIG. 2, the cylindrical upper body 105 has a recess located along its bottom edge that receives a complementary snap fit rim on the upper edge of the cylindrical intermediate body 107. Similarly, the cylindrical intermediate body 107 has a recess located along its bottom edge that receives a complementary snap fit rim on the inner edge of the slip plate 113. An optional O-ring can also be implemented at each recess and snap fit rim to further inhibit the flow of air through the fixture. The recess and complementary snap fit rim method for joining components can simplify and reduce the costs associated with designing, manufacturing, and assembling the luminaire. It should also be understood that the recess and complementary snap fit rim are only one example and in other embodiments the components of the luminaire can be joined with fasteners or other mechanisms.

Figure 7:
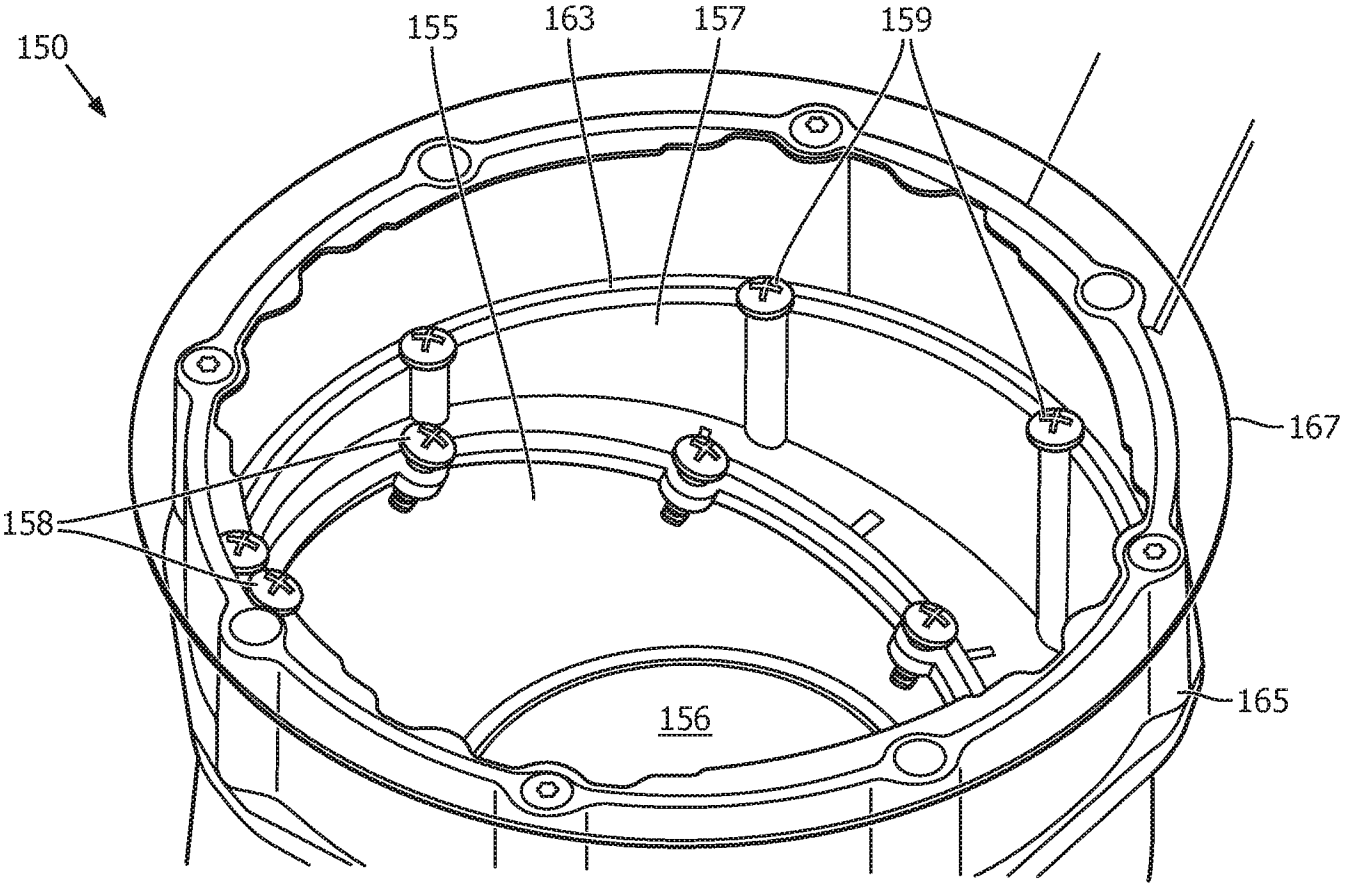
FIG. 7 is a bottom perspective view of an alternate embodiment of a rotatable luminaire.

FIG. 7 illustrates an alternate to the recess and complementary snap fit rim method for joining components of a luminaire. The components shown in FIG. 7 are generally similar to the components previously described in connection with example luminaire 100. However, instead of the recess and complementary snap fit rim method of luminaire 100, fasteners are used to join components of luminaire 150. Luminaire 150 in FIG. 7 is shown upside down with a view into the bottom of the luminaire. Similar to luminaire 100, luminaire 150 comprises a base flange 167, a base 165, a slip plate 163, a cylindrical intermediate body 157, a cylindrical upper body 155, and a light module 156. Instead of the recess and complementary snap fit rim method for joining components used in luminaire 100, luminaire 150 uses an arrangement of fasteners 158 and 159 to join the components. Specifically, fasteners 158 join the cylindrical upper body 155 to a flange on the inner surface of the cylindrical intermediate body 157. Similarly, fasteners 159 join the cylindrical intermediate body 157 to the slip plate 163. The fasteners 158 and 159 can be loosened to adjust the position of the cylindrical upper body 155 or the cylindrical intermediate body 157 and then tightened once the components are in the desired position. As with luminaire 100, the slip plate 163 of luminaire 150 is attached to the base 165 with additional fasteners, which are not shown in FIG. 7. Those of skill in this field will appreciate that a variety of different fasteners other than the screw fasteners 158 and 159 shown in FIG. 7 can be used.

Figures 8A, 8B:
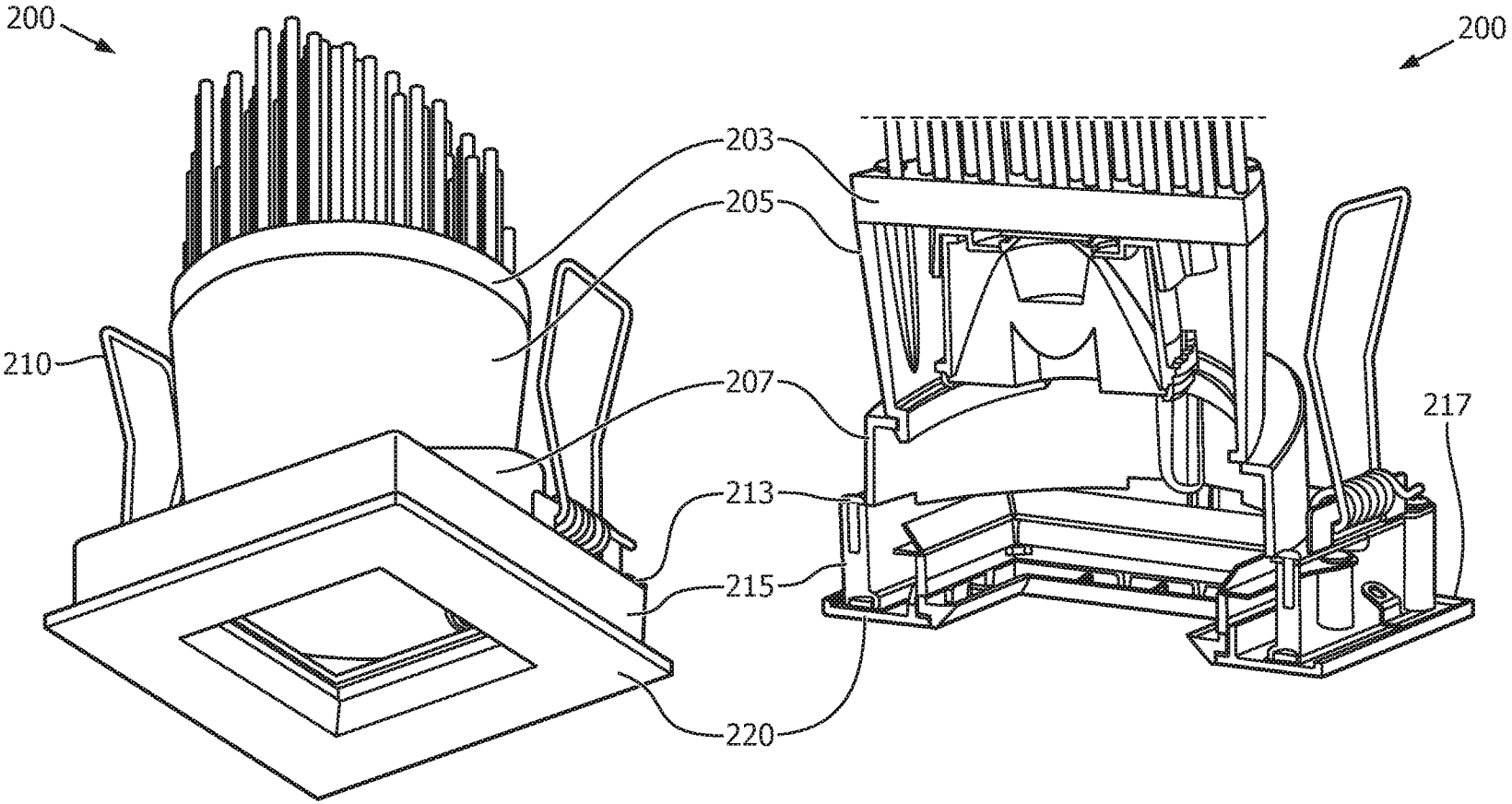
FIG. 8A is a bottom perspective view of a rotatable luminaire in accordance with an example embodiment.
FIG. 8B is a cross-sectional view of the rotatable luminaire of FIG. 8A in accordance with an example embodiment.

Referring now to FIGS. 8A and 8B, an alternate embodiment of an adjustable luminaire 200 is illustrated. Many of the components shown in example luminaire 200 are similar to the components previously described in connection with example luminaire 100 and analogous components are indicated by the same last two reference number digits. It should be assumed that the analogous components illustrated in FIGS. 8A and 8B operate in a similar manner to the corresponding components of FIGS. 1-4 and a detailed description will not be repeated. Briefly, as in the embodiment of FIGS. 1-4, luminaire 200 of FIGS. 8A and 8B includes a top 203, a cylindrical upper body 205, a cylindrical intermediate body 207, and retention brackets 210.

Example luminaire 200 differs from example luminaire 100 in that luminaire 200 has a square shaped base 215, square shaped slip plate 213, and square trim assembly 220. Additionally, instead of a base flange that extends around the entire perimeter of the base as shown in FIGS. 1 and 2, luminaire 200 has four discrete corner flanges 217 located at each corner of the base 215 that secure the luminaire 200 against the ceiling when installed. It should be understood that in other alternate embodiments, the shape of the base, the slip plate, the base flange, and the trim assembly can be modified to other forms as needed.

Figures 9, 10:
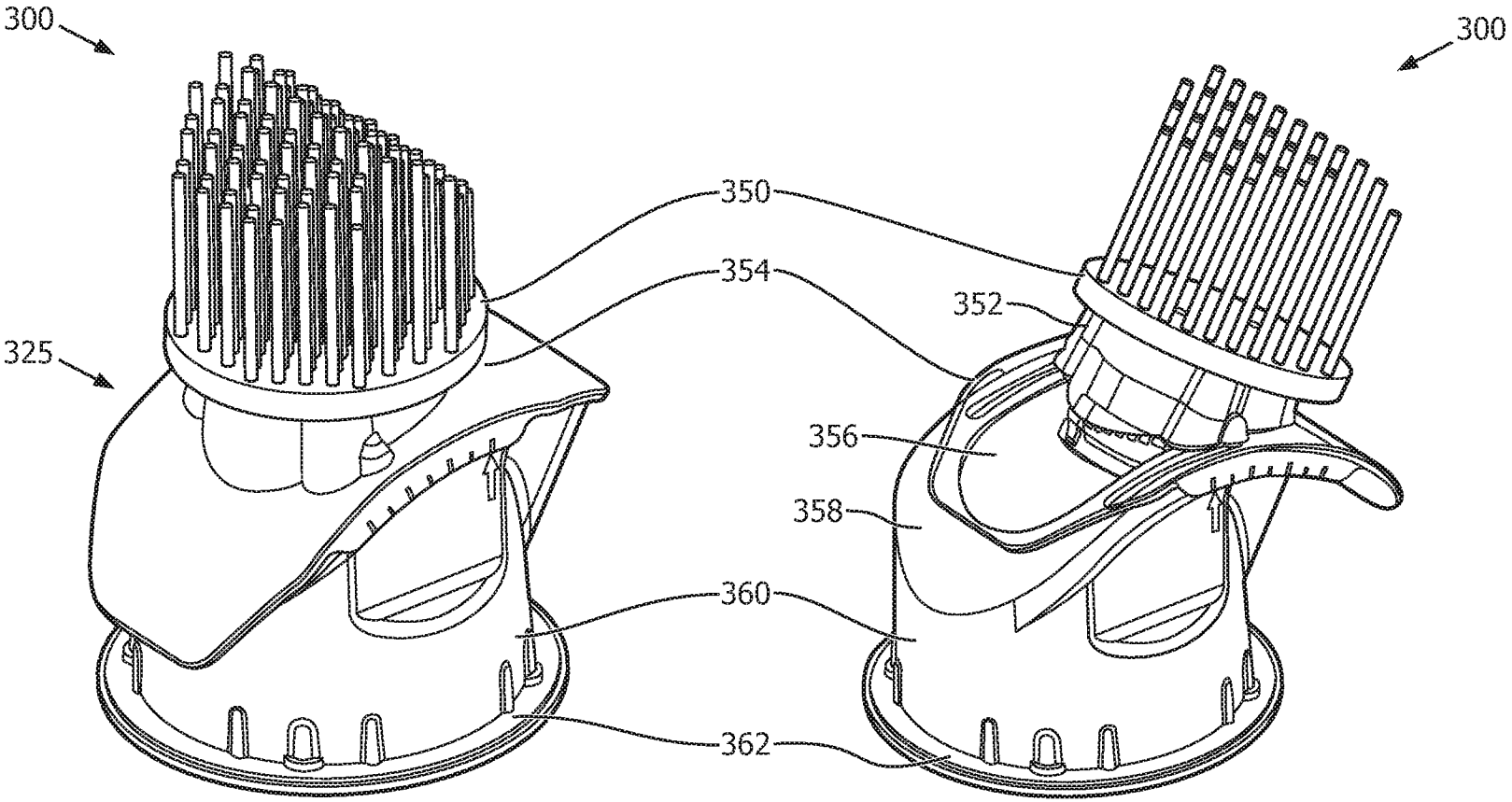
FIG. 9 is a top perspective view of a rotatable luminaire in accordance with an example embodiment.
FIG. 10 is a top perspective view of the rotatable luminaire of FIG. 9 with a portion hidden from view and showing internal features in accordance with an example embodiment.

Referring now to FIGS. 9-16, yet another example embodiment of an adjustable luminaire 300 is illustrated. Example luminaire 300 differs from example luminaires 100 and 200 in several aspects. First, example luminaire 300 has an upper body 352 mounted to an upper base 354. The upper body 352 comprises a generally cylindrical wall defining a cavity in which a light module 368 is disposed. The luminaire 300 also comprises a lower body 360 comprising a generally cylindrical wall defining a cavity and a bearing surface 358 at the top of the lower body 360. The upper base 354 and the bearing surface 358 each have a curvature that is typically of the same degree so that the upper base 354 can slide in a rotating manner on the bearing surface 358. The bearing surface 358 also has an opening 356 through which the light module 368 can extend and through which light is emitted. As shown in FIG. 10, the opening 356 in the bearing surface 358 is completely covered by the upper base 354 throughout the range of positions to which the upper base 354 can be moved in order to inhibit air flow through the luminaire 300 to satisfy one or more air tight standards when required.

Figure 12:
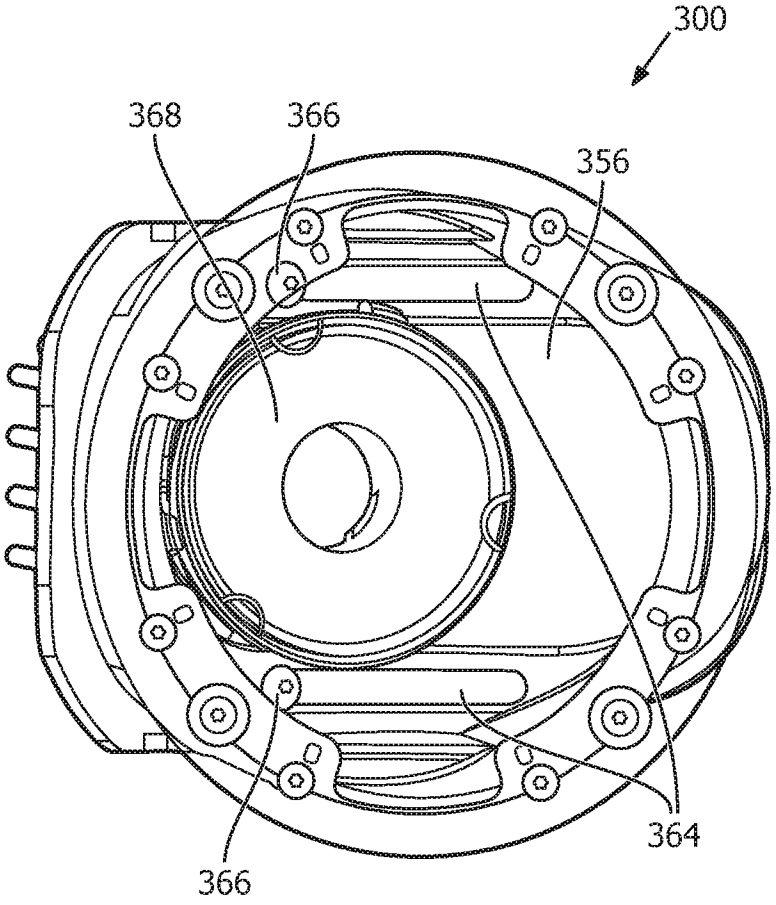
FIG. 12 is a bottom view of the rotatable luminaire of FIG. 9 in accordance with an example embodiment.
Figure 11:
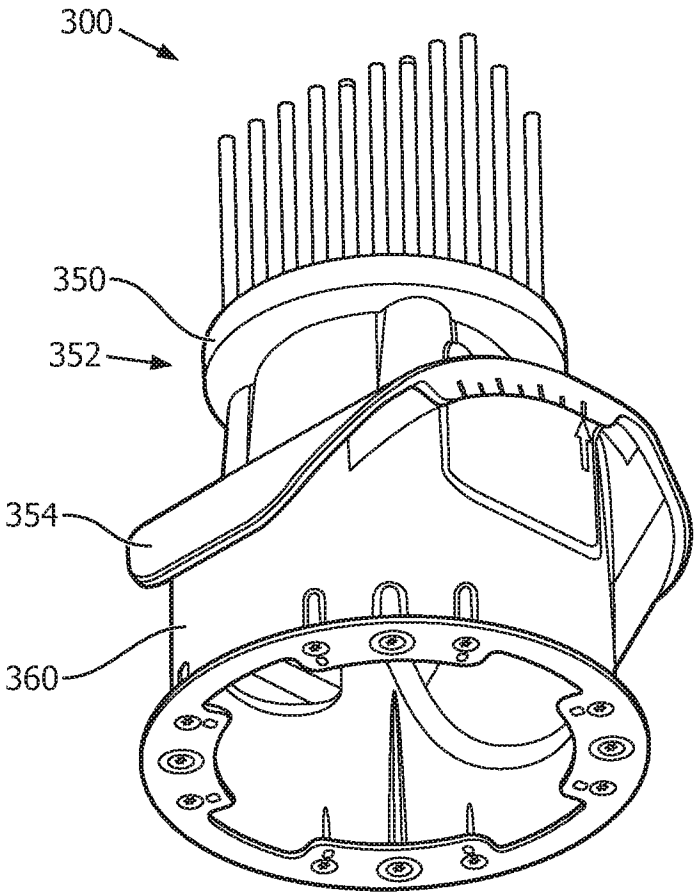
FIG. 11 is a bottom perspective view of the rotatable luminaire of FIG. 9 in accordance with an example embodiment.

As illustrated in the bottom view of luminaire 300 in FIG. 12, the bearing surface 358 also can comprise two slots 364 through which fasteners 366 can pass. The fasteners 366 are loosened to permit the upper base 354 to slide in either direction along the bearing surface 358. The arrow and degree marking shown on the outer surface of the upper base 354 and the lower body 360 assist the user in selecting an angle for the light emitted from the luminaire 300. Once the desired angle for light emission is set, the fasteners 366 can be tightened in slots 364 so that the upper base 354 does not move.

The upper body 352 also comprises a top 350, which can include a heat sink for absorbing heat from a light source in the light module 368. The lower body 360 also comprises a flange 362 for securing the luminaire against a ceiling when installed in a recess.

Figure 13:
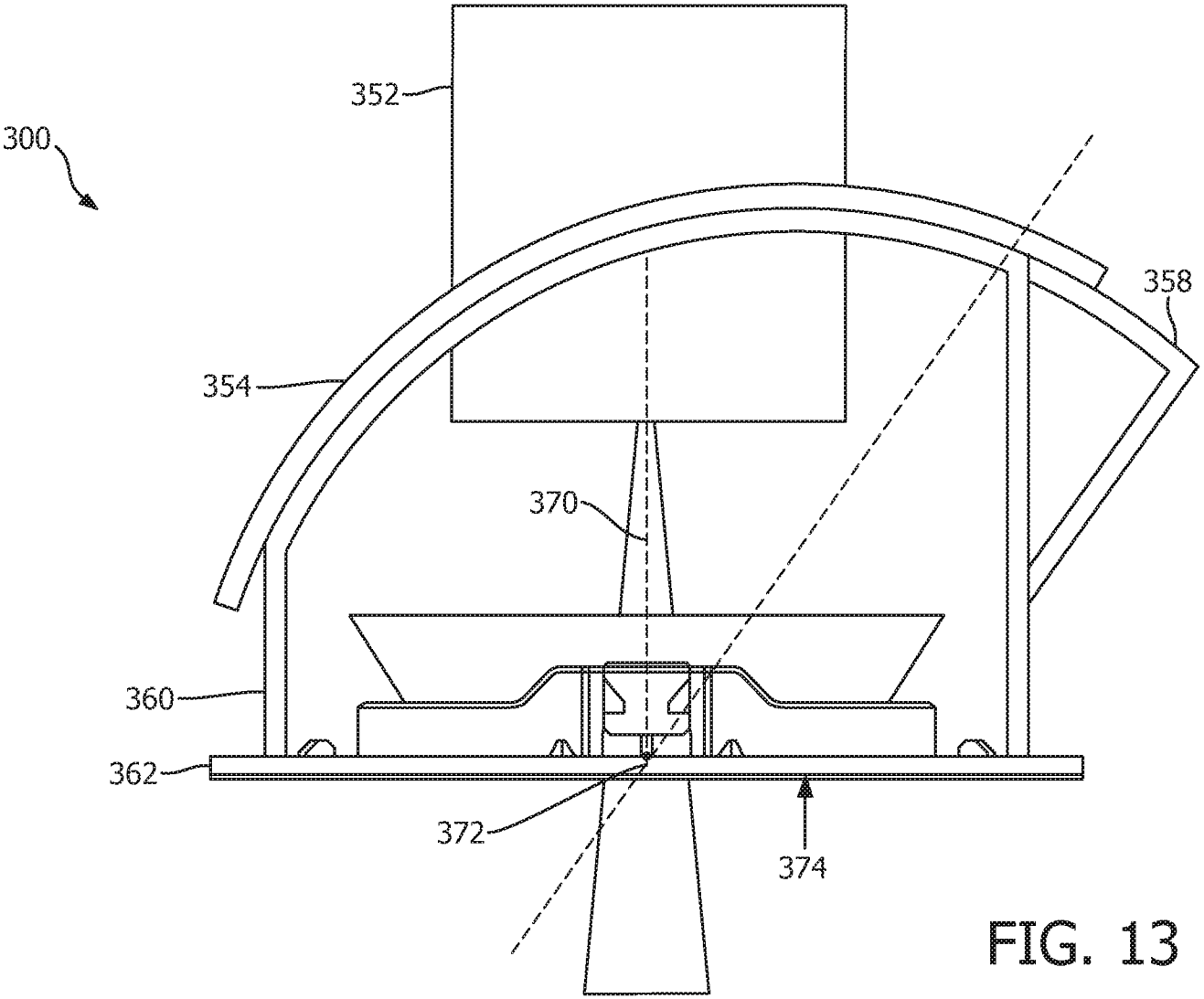
FIG. 13 is a side view of the rotatable luminaire of FIG. 9 with a side hidden from view and showing the internal features in accordance with an example embodiment.
Figure 14:
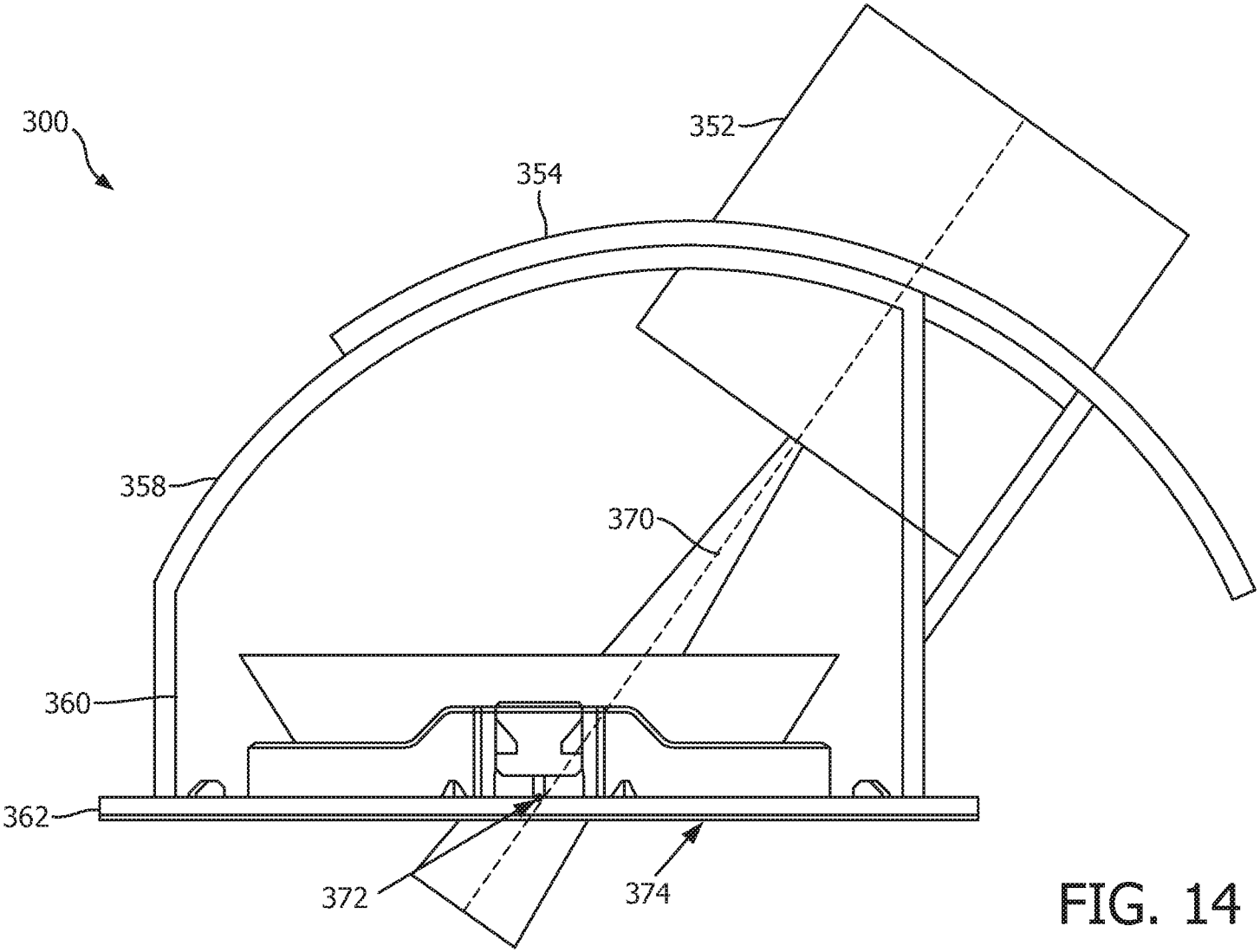
FIG. 14 is a side view of the rotatable luminaire of FIG. 9 with a side hidden from view and showing the internal features in accordance with an example embodiment.
Figure 15:
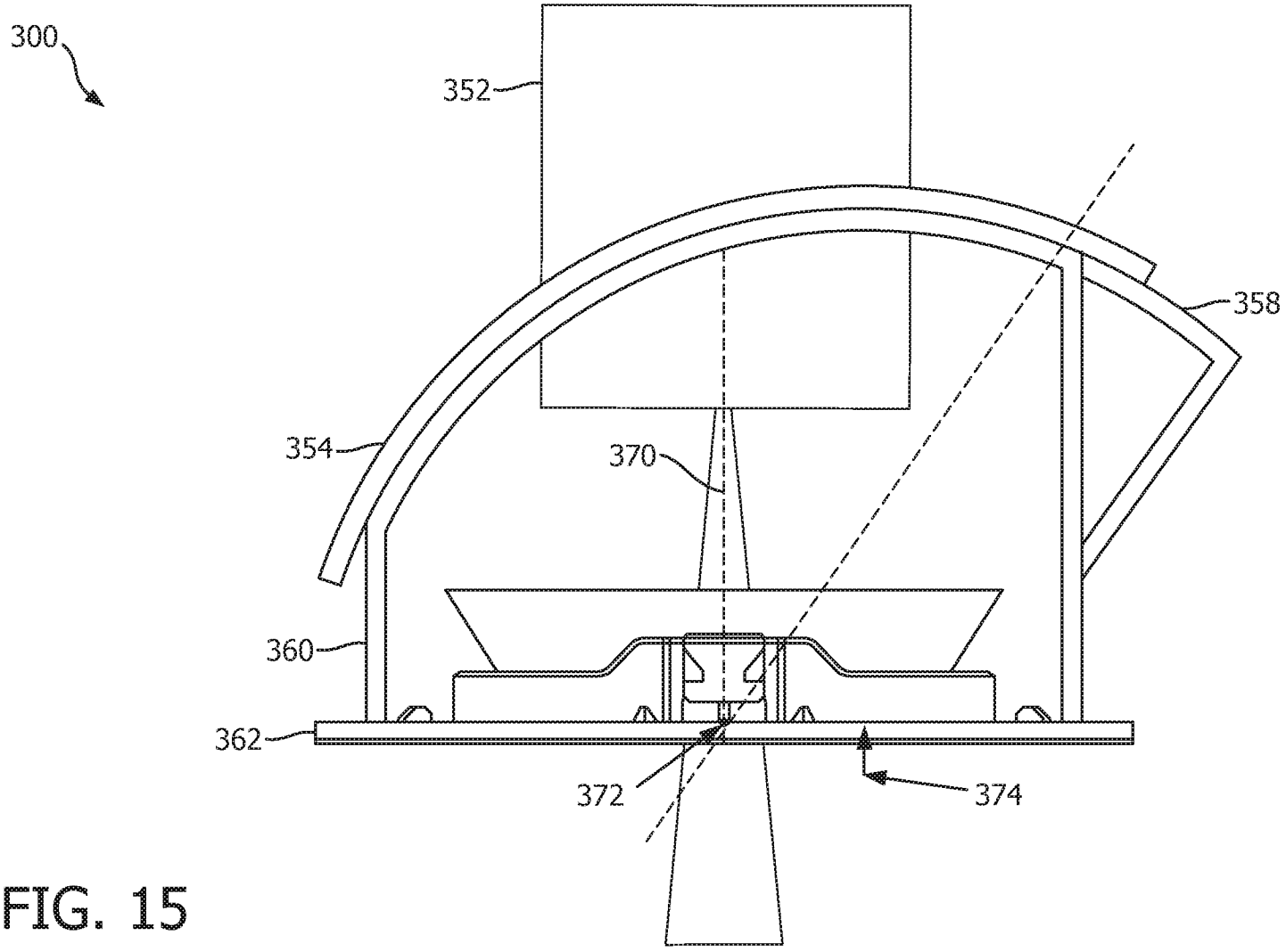
FIG. 15 is a side view of the rotatable luminaire of FIG. 9 with a side hidden from view and showing the internal features in accordance with an example embodiment.

FIGS. 13-16 illustrate the orientation of the light emitting axis 370 in two different adjustment positions for the luminaire 300. In FIGS. 13 and 15, the upper body 352 is in the zero degree position and the light emitted by the light module 368 is emitted in a vertical downward direction. The light is emitted along the light emitting axis 370 and passes through the pivot point 372 located at the light emitting opening in the lower body 360. As with the previous embodiments, it is desirable for the light emitting axis 370 to pass through the pivot point 372 throughout the range of motion of the upper body 352 and the upper base 354 along the bearing surface 358. In other words, it is undesirable for the pivot point to move such that the emitted light passes through different areas of light emitting opening as the upper body 352 is moved to different positions. The pivot point 372 is held in a constant position by placing the center point 374 at an offset distance from the pivot point 372. The center point 374 is the center of the radius that defines the curvature of the bearing surface 358 and the upper base 354.

Figure 16:
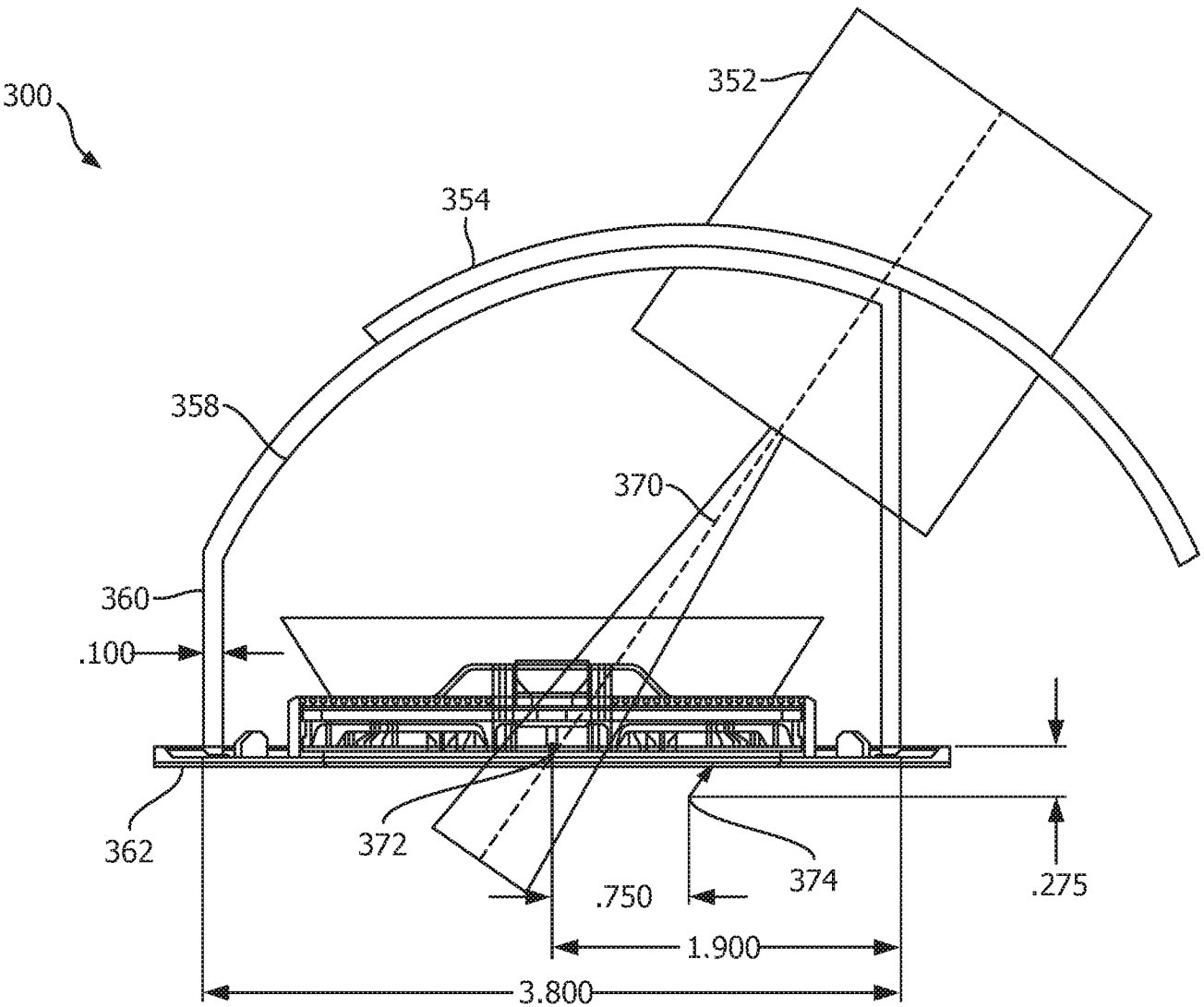
FIG. 16 is a side view of the rotatable luminaire of FIG. 9 with a side hidden from view and showing the internal features in accordance with an example embodiment.

As illustrated in FIGS. 14 and 16, when the upper base 354 slides along the bearing surface 358 to a position that is 30 degrees from the vertical position shown in FIGS. 13 and 15, the upper base 354 rotates about the center point 374. Because the center point 374 is at the offset distance from the pivot point 372, the light emitting axis 370 continues to pass through the pivot point 372 when the luminaire 300 is at the 30 degree orientation shown in FIGS. 14 and 16. The position of the center point 374 at the offset distance from the pivot point 372 ensures that the light emitting axis 370 will pass through the pivot point 372 at any orientation of the upper body 352 from the zero degree position shown in FIGS. 13 and 15 to the 30 degree orientation shown in FIGS. 14 and 16.

Figure 18:
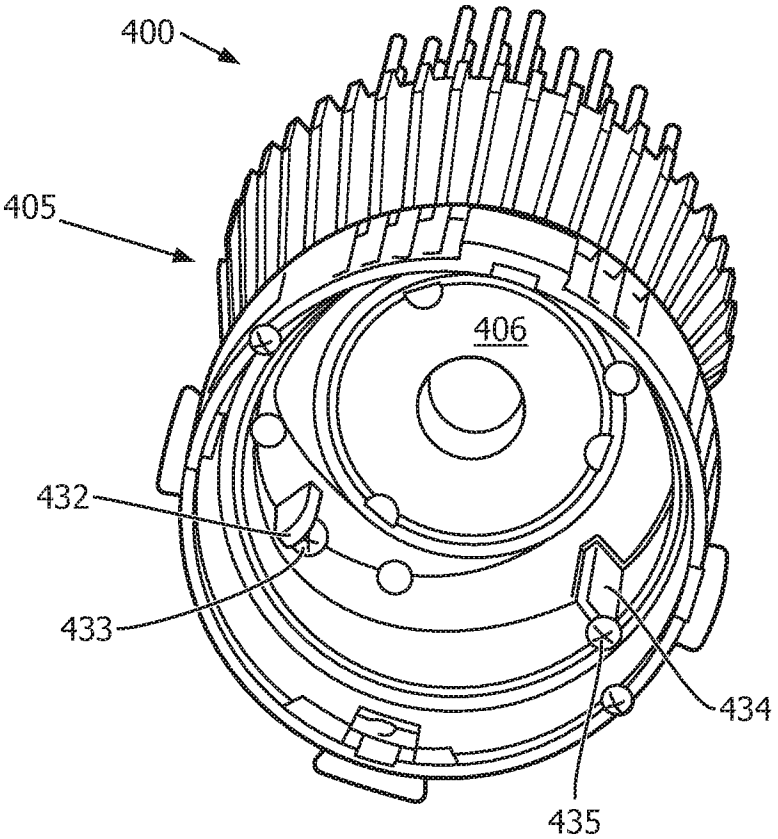
FIG. 18 is a bottom perspective view of the example rotatable luminaire of FIG. 17.
Figure 17:
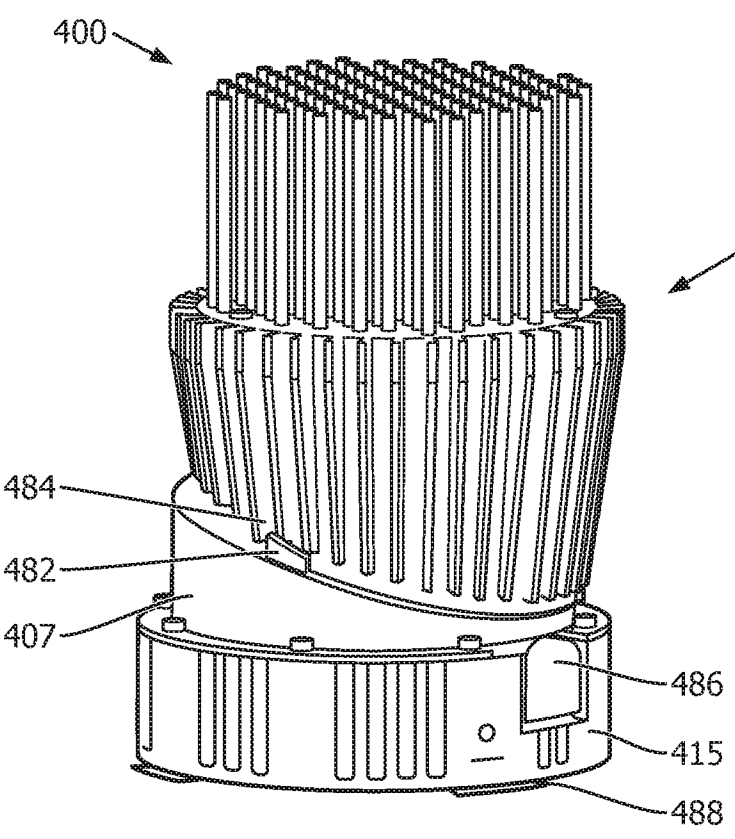
FIG. 17 is a top perspective view of a rotatable luminaire in accordance with another example embodiment.

Referring now to FIGS. 17 and 18, another example embodiment of an adjustable luminaire 400 is illustrated. Many of the components shown in example luminaire 400 are similar to the components previously described in connection with example luminaire 100 and analogous components are indicated by the same last two reference number digits. It should be assumed that the analogous components illustrated in FIGS. 17 and 18 operate in a similar manner to the corresponding components of FIGS. 1-4 and a detailed description will not be repeated. Briefly, as in the embodiment of FIGS. 1-4, luminaire 400 of FIGS. 17 and 18 includes a cylindrical upper body 405, a cylindrical intermediate body 407, and a base 415. Luminaire 400 also includes adjustment tabs similar to the tabs illustrated in FIGS. 5 and 6. Luminaire 400 includes an upper tab 432 attached to the inner surface of the cylindrical upper body 405 and an intermediate tab 434 attached to the inner surface of the cylindrical intermediate body 407. The upper tab 432 and intermediate tab 434 can be used to adjust the rotation of the cylindrical upper body 405 and the cylindrical intermediate body 407, respectively, to a desired position and the fasteners 433, 435 adjacent to each tab can be used to lock the respective component into place. When the fasteners 433, 435 adjacent to each of the upper tab 432 and the intermediate tab 434 are tightened, the tightening action clamps the components of the luminaire 400 together, which can create an air tight seal for the luminaire 400. Thus, luminaire 400 can be adjusted in a manner similar to that illustrated in FIGS. 3 and 4.

Example luminaire 400 differs from example luminaire 100 in certain respects. First, in addition to the heat sink elements projecting from the top of luminaire 400, heat sink fins are included around the outer surface of the cylindrical upper body 405 for additional dissipation of heat generated by a light module 406. Luminaire 400 includes a stop tab 482 disposed on an upper edge of the cylindrical intermediate body 407. Stop tab 482 is positioned so that it will engage an elongated heat sink fin 484 once the cylindrical upper body 405 is rotated through a certain number of degrees. As one example, the cylindrical upper body 405 can be limited to rotation from 0 degrees to 30 degrees. It should be understood that the stop tab 482 could also be located at other positions on the luminaire or could be eliminated entirely as it is not a required feature.

Example luminaire 400 also differs from example luminaire 100 in that luminaire 400 includes one or more clamp wings 486 and one or more foot clamps 488 attached to the base 415. The clamp wing 486 and foot clamp 488 work together to clamp the base 415 to a ceiling. The foot clamp 488 engages the bottom surface of the ceiling and the clamp wing 486 pivots outward from the base 415 to engage the top surface of the ceiling. Additionally, the clamp wing 486 can pivot on a threaded fastener or other adjustable fastener attached to the base 415 so that the height of the clamp wing 486 can be adjusted to accommodate ceilings of differing thickness. It should be understood that the clamp wing 486 and foot clamp 488 are optional features and in other embodiments they can be eliminated or replaced with other attachment mechanisms.

Figure 20:
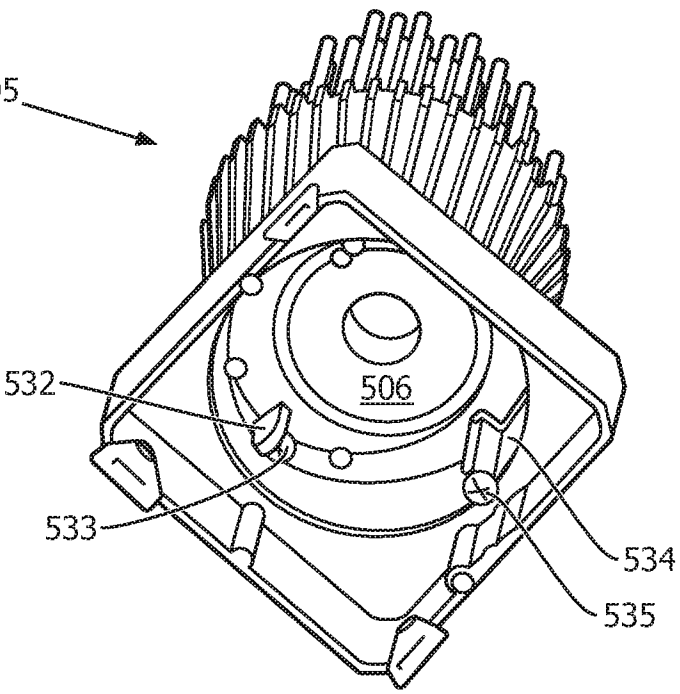
FIG. 20 is a bottom perspective view of the example rotatable luminaire of FIG. 19.
Figure 19:
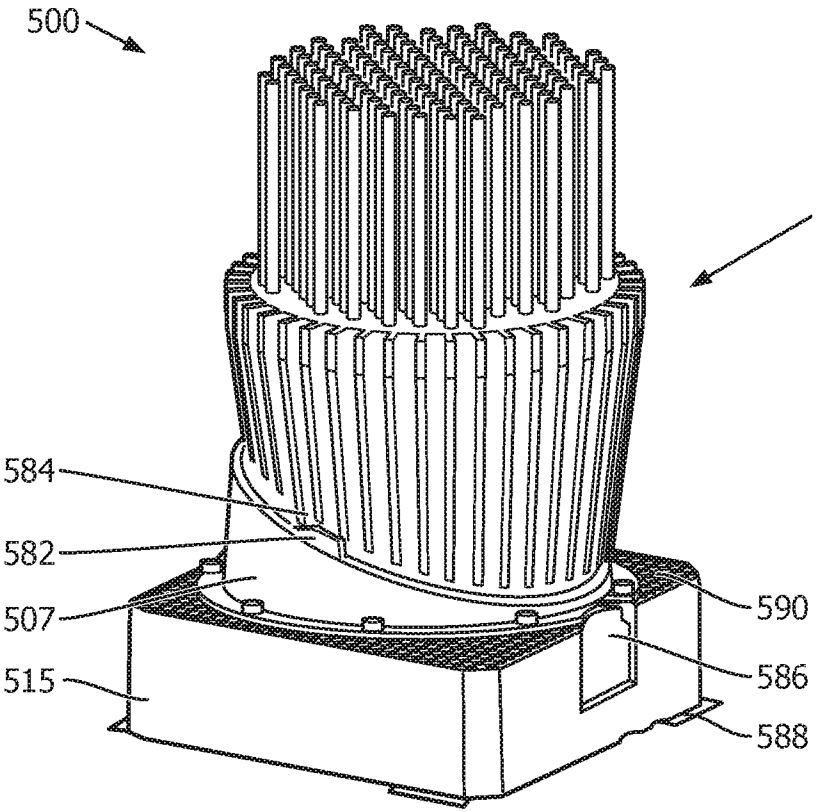
FIG. 19 is a top perspective view of a rotatable luminaire in accordance with yet another example embodiment.

Referring now to FIGS. 19 and 20, another example embodiment of an adjustable luminaire 500 is illustrated. Many of the components shown in example luminaire 500 are similar to the components previously described in connection with example luminaires 100 and 400 and analogous components are indicated by the same last two reference number digits. It should be assumed that the analogous components illustrated in FIGS. 19 and 20 operate in a similar manner to the corresponding components of FIGS. 1-4, 17, and 18 and a detailed description will not be repeated. Briefly, as in the embodiment of FIGS. 1-4, 17 and 18, luminaire 500 of FIGS. 19 and 20 includes a cylindrical upper body 505, a cylindrical intermediate body 507, and a base 515. Luminaire 500 also includes adjustment tabs similar to the tabs illustrated in FIGS. 5 and 6. Luminaire 500 includes an upper tab 532 attached to the inner surface of the cylindrical upper body 505 and an intermediate tab 534 attached to the inner surface of the cylindrical intermediate body 507. The upper tab 532 and intermediate tab 534 can be used to adjust the rotation of the cylindrical upper body 505 and the cylindrical intermediate body 507, respectively, to a desired position and the fasteners 533, 535 adjacent to each tab can be used to lock the respective component into place. Thus, luminaire 500 can be adjusted in a manner similar to that illustrated in FIGS. 3 and 4.

Similar to luminaire 400 of FIGS. 17 and 18, luminaire 500 of FIGS. 19 and 20 also includes an optional stop tab 482 and elongated heat sink fin 484 that can be used to limit the range of rotation of the cylindrical upper body 505. Luminaire 500 also includes optional clamp wing 586 and optional foot clamp 588 for securing the base 515 to a ceiling.

Luminaire 500 also includes a unique heat dissipation feature 590 as part of the base 515. As illustrated in FIG. 19, the heat dissipation feature 509 is a series of dimples on the base 515. The series of dimples increase the surface area of the base 515 which in turn increases the ability of the base to dissipate heat. Example luminaire 500 is a recessed light fixture that typically would be recessed into a ceiling. Because heat is generated by light module 506 located above the ceiling and because the air below the ceiling is typically cooler, it is beneficial to increase the ability of the base 515 to transfer heat from the upper portion of the luminaire 500 to the cooler air below the ceiling. While the heat dissipation feature 509 is shown in example luminaire 500 as a series of dimples on the top surface of the base 515, in other examples the series of dimples can be located on additional surfaces of the luminaire 500. Additionally, while the heat dissipation feature 509 is shown as a series of dimples in example luminaire 500, in other embodiments the pattern of the heat dissipation feature 509 can take other forms that increase the surface area of the base 515 or other parts of the luminaire 500.

For any figure shown and described herein, one or more of the components may be omitted, added, repeated, and/or substituted. Accordingly, embodiments shown in a particular figure should not be considered limited to the specific arrangements of components shown in such figure. Further, if a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A luminaire comprising:

a cylindrical upper body comprising an upper wall of varying height and a light module, the upper wall forming an upper angled opening, the light module configured to emit light along a light emitting axis;

a cylindrical intermediate body, the cylindrical upper body rotatably attached at the upper angled opening to the cylindrical intermediate body, the cylindrical intermediate body comprising an intermediate wall of varying height, the intermediate wall forming an intermediate angled opening and an intermediate lower opening, wherein the cylindrical upper body is rotated about a first axis extending through the intermediate angled opening; and a base, the cylindrical intermediate body rotatably attached at the intermediate lower opening to the base, the base comprising a light emitting opening for emitting light from the light module.

2. The luminaire of claim 1, wherein the cylindrical upper body and the cylindrical intermediate body are centered about an offset axis.

3. The luminaire of claim 2, wherein the light module and the base are centered about a pivot point axis that passes through a pivot point located at the light emitting opening.

4. The luminaire of claim 3, wherein the cylindrical upper body directs light along the light emitting axis to the pivot point at any angle of rotation of the cylindrical upper body.

5. The luminaire of claim 3, wherein the cylindrical upper body can direct light at a light emitting angle ranging from 0 degrees to 35 degrees, wherein the light emitting angle is an acute angle between the light emitting axis and the pivot point axis.

6. The luminaire of claim 2, wherein the cylindrical intermediate body is rotatable about the offset axis.

7. The luminaire of claim 1, wherein the upper angled opening defines an upper plane forming an acute angle of approximately 17.5 degrees with the upper wall where a height of the upper wall is greatest.

8. The luminaire of claim 7, wherein the intermediate angled opening defines an intermediate plane that is parallel with the upper plane and that forms an acute angle of approximately 17.5 degrees with the intermediate wall where a height of the intermediate wall is greatest.

9. The luminaire of claim 1, wherein the cylindrical upper body further comprises a tab on an inner surface of the cylindrical upper body for adjusting a light emitting angle and for locking the cylindrical upper body in place.

10. The luminaire of claim 1, wherein the cylindrical intermediate body further comprises a tab on an inner surface of the cylindrical intermediate body for adjusting a direction of the light and for locking the cylindrical intermediate body in place.

11. The luminaire of claim 1, wherein the cylindrical upper body further comprises an elongated heat sink fin, and wherein the cylindrical intermediate body, further comprises a stop tab located on a top edge of the cylindrical intermediate body, the stop tab disposed to engage the elongated heat sink fin when the cylindrical upper body is rotated to a specified position.

12. The luminaire of claim 1, wherein the base comprises:

a pivoting clamp wing; and a foot clamp, wherein the pivoting clamp wing and the foot clamp are configured to secure the base to a ceiling.

13. The luminaire of claim 1, wherein the base further comprises a series of dimples that increase the surface area of the base.

14. The luminaire of claim 1, wherein the cylindrical upper body further comprises a recess in the upper wall into which the cylindrical intermediate body fits.

15. The luminaire of claim 1, wherein the cylindrical intermediate body further comprises a recess in the intermediate wall into which a slip plate fits.

16. The luminaire of claim 1, further comprising:

a slip plate mounted on the base, the slip plate configured to support one or more retention brackets; and a base flange for securing the luminaire against a ceiling.

17. A luminaire comprising:

a cylindrical upper body comprising an upper wall of varying height and a light module, the upper wall forming an upper angled opening, the light module configured to emit light along a light emitting axis, wherein the upper wall has a top end and a bottom end that are substantially planar, wherein the top end and the bottom end of the upper wall are antiparallel with respect to each other; and a cylindrical intermediate body, the cylindrical upper body rotatably attached at the upper angled opening to the cylindrical intermediate body, the cylindrical intermediate body comprising an intermediate wall of varying height and a base, the intermediate wall forming an intermediate angled opening and an intermediate lower opening, the base comprising a light emitting opening for emitting light from the light module, wherein the intermediate wall has a top end and a bottom end that are substantially planar, wherein the top end and the bottom end of the intermediate wall are antiparallel with respect to each other, and wherein the top end of the intermediate wall and the bottom end of the upper wall are parallel with respect to each other as the cylindrical upper body rotates with respect to the cylindrical intermediate body.

18. The luminaire of claim 17, wherein the cylindrical upper body and the cylindrical intermediate body are centered about an offset axis.

19. The luminaire of claim 18, wherein the light module and the base are centered about a pivot point axis that passes through a pivot point located at the light emitting opening.

20. The luminaire of claim 19, wherein the cylindrical upper body directs light along the light emitting axis to the pivot point at any angle of rotation of the cylindrical upper body.

* * * * *